US008665163B2

(12) United States Patent
Apostolos et al.

(10) Patent No.: US 8,665,163 B2
(45) Date of Patent: Mar. 4, 2014

(54) WIDE BAND EMBEDDED ARMOR ANTENNA

(75) Inventors: John T. Apostolos, Lyndeborough, NH (US); William Mouyos, Windham, NH (US); Henry A. Karwacki, Salem, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 257 days.

(21) Appl. No.: 13/196,504

(22) Filed: Aug. 2, 2011

(65) Prior Publication Data

US 2012/0293380 A1 Nov. 22, 2012

Related U.S. Application Data

(60) Provisional application No. 61/486,956, filed on May 17, 2011.

(51) Int. Cl.
*H01Q 1/32* (2006.01)

(52) U.S. Cl.
USPC ..... 343/713; 343/795

(58) Field of Classification Search
USPC ..... 343/711, 713, 795, 815, 817, 818, 873
See application file for complete search history.

(56) References Cited

U.S. PATENT DOCUMENTS

| | | | | |
|---|---|---|---|---|
| 3,152,330 | A * | 10/1964 | Chatelain | 343/705 |
| 4,783,666 | A | 11/1988 | Ast et al. | |
| 6,052,098 | A * | 4/2000 | Killen et al. | 343/795 |
| 6,300,906 | B1 * | 10/2001 | Rawnick et al. | 343/700 MS |
| 6,329,958 | B1 * | 12/2001 | McLean et al. | 343/787 |
| 6,833,815 | B2 | 12/2004 | Apostolos | |
| 7,129,904 | B2 * | 10/2006 | Chen | 343/795 |
| 2004/0201532 | A1 | 10/2004 | Apostolos et al. | |
| 2005/0104795 | A1 | 5/2005 | Voigtlaender | |
| 2006/0176211 | A1 | 8/2006 | Mohamadi | |
| 2011/0260935 | A1 * | 10/2011 | Bortoin et al. | 343/713 |
| 2012/0293381 | A1 * | 11/2012 | Apostolos et al. | 343/713 |

FOREIGN PATENT DOCUMENTS

WO 2010053619 5/2010

* cited by examiner

*Primary Examiner* — Tho G Phan
(74) *Attorney, Agent, or Firm* — Robert K. Tendler; Daniel J. Long

(57) ABSTRACT

An extremely thin embedded antenna for an armor-carrying vehicle utilizes a dipole driven element to the inside of the armor plate and a parasitically-driven dipole element on top of the armor plate, with the parasitic element providing appropriate forward gain and antenna matching characteristics such that there need be no aperturing of the armor plate in order to feed the antenna. In one embodiment, the bowtie antenna elements are elongated, extended or expanded by outboard antenna sections which are spaced from the distal ends of the corresponding bowties, with a meanderline choke bridging the gap between a bowtie element and its extended portion.

15 Claims, 10 Drawing Sheets

WIDE BAND EMBEDDED ARMOR ANTENNA

RELATED APPLICATIONS

This application claims rights under 35 USC §119(e) from U.S. Application Ser. No. 61/486,956 filed May 17, 2011, the contents of which are incorporated herein by reference.

FIELD OF THE INVENTION

This invention relates to an antenna utilized on armored vehicles and more particularly to an armor-embedded wide band parasitically-fed antenna system.

BACKGROUND OF THE INVENTION

As described in provisional patent application 61/486,956 filed May 17, 2011, it is desirable to provide a thin structure for an antenna embedded in an armor panel and more particularly to provide a parasitic element on top of the armor layer so that when driving the antenna there are no apertures in the armor which would degrade performance. In one embodiment the aperture-less embedded antenna system includes a direct fed dipole on the underneath side of the armor layer such that the armor layer is not pierced. There is an identical dipole on the top of the armor layer that is parasitically fed by the driven dipole. In one embodiment the dipoles are in the form of bowties.

As described in the above-identified provisional patent application, it is desirable to replace antennas such as whip antennas on tanks, armored vehicles and the like with broadband antennas that are conformal to the vehicle itself.

Having a forest of antennas that extend from the armored vehicle is undesirable because they are susceptible to damage and attack. It is therefore desirable to be able to provide an antenna system which is embedded in the armor such that the armor protects the embedded antenna both against explosive attacks and ballistic penetration while at the same time eliminating the need for antenna whips, dashes and the like which are easily blown off with explosive charges, thereby precluding communication with the vehicle.

It is noted that the thin structure of present armor panels presents the greatest challenge to antenna design. Whether the panel is metal backed itself or is mounted on a metal vehicle, the close proximity of a conductive surface to a radiating element creates a ground plane that is too close to the element. As will be appreciated in traditional antenna design, the ground plane is spaced at least a quarter wavelength away from any driven element. However, when dealing with armor for vehicles such as tanks and the like, the spacing between the ground plane and the driven element of the antenna is on the order of hundredths of a wavelength.

While initially thought that this limitation would be a disqualifying factor in the antenna design, it has been shown that a thin antenna structure can be created which does not rely on deep cavities behind the elements. Such structures have been described in U.S. Pat. No. 6,833,815 which relates to Cavity Embedded Meanderline Loaded Antennas. In this patent the antenna described is a conformal antenna which is cavity-backed.

In one embodiment of this Cavity Embedded Meanderline Antenna a bowtie dipole is utilized, with the distal ends of the dipole being coupled to surrounding metal utilizing a meanderline structure.

Since it is possible to completely quantify the electromagnetic characteristics of the armor materials one can establish the permittivity and loss of each piece of the armor recipe that affects the effective electrical length and efficiency of the radiating structure. This being said, it was thought that the dielectric constants of overlying or intermediate materials could be tailored to reduce VSWR and maximize gain. It was thought that this could be accomplished by completely characterizing the boundaries between the layers within the armor as well as the boundary to the outside or free space.

While the presence of a dielectric allows one to accommodate the thin armor structure, it has been found that regardless of the dielectric matching a thin stacked element array is achievable using a driven bowtie dipole to the inside of an alumina tile armor plate and a parasitic element in the form of an identical parasitically driven bowtie is on the outside of the armor plate. As discussed in this provisional patent application, it is possible to use an embedded driven element and an outer parasitic element approach that does not depend heavily on impedance matching layers.

More specifically it was found that by utilizing the parasitic element on top of the armor plate and by driving it with a driven element beneath the armor plate, satisfactory antenna performance can be obtained in the 225-450 MHz range.

More particularly, when utilizing a parasitically-driven array in which the driven element is beneath the armor layer and the parasitically-driven element is above or to the outside of the armor layer, it was found that one can have unity gain across the 225-450 MHz range with a VSWR of 3:1 or less across the range.

There is however a problem in extending the range of such an armor-embedded antenna for wideband to cover for instance 30 MHz to 455 MHz. It will be appreciated that if a single wideband antenna could be embedded in the armor, then one can have a wide range of communications options without having a forest of antennas each tuned to a separate frequency band and each vulnerable to attack.

SUMMARY OF THE INVENTION

In order to achieve wide band embedded antenna performance, in the subject invention a bowtie dipole is used both as the directly driven element and as the parasitically-driven dipole element, in which the bowtie distal edges are extended with outboard plates spaced from the associated bowtie element. By providing a choke between the dipole and its extension with a cut off at approximately 225 MHz, the antenna can be made to operate in two bands, one from 30 MHz to 225 MHz and the other from 225 MHz to 455 MHz. The choke in one form is a variable impedance transmission line, or VITL, commonly a 4 pole photonic band gap device called a meanderline. This choke is used to cut off frequencies below 225 MHz such that the dipole without extensions resonates in the 225 MHz to 455 MHz UHF band. On the other hand, the meanderline choke acts as a short from the dipole to its extension to extend the volume of the antenna such that the dipole resonates from 30 MHz to 225 MHz in the VHF band.

The result is that for the VHF portion of the band the variable impedance transmission line has no effect other than being a short across the adjacent sections of the bowtie. However for UHF operation, the variable impedance transmission line or meanderline in essence disconnects the VHF portions of the antenna from the UHF portions of the antenna such that the antenna looks smaller and is therefore capable of operating in the 225-450 MHz UHF band.

In one embodiment, the long distal edge of a bowtie element for UHF is for instance 20 inches long to cover 225 to 450 MHz. However, by utilizing the outboard bowtie extensions for the VHF band, the distal edge length is increased to 40 inches which supports a range of 30 MHz to 225 MHz.

In summary, the break between the extended portion of the bowtie and the original bowtie is straddled by a variable impedance transmission line element, the purpose of which is to act as a choke above 225 to facilitate operation from 225 to 450 MHz by acting as a four-fold photonic band gap device with a cut off at 225 MHz.

In one embodiment a plurality of panels, each carry a dipole pair, are located side by side, for instance on a tank, and may driven in phase or may be phased to provide a sharp antenna lobe in a given direction. Thus, the gain in a particular direction may be increased with traditional antenna steering. As will be appreciated, for a steerable beam one can obtain increased gain in a particular pointing direction.

With a vertically polarized four panel array, the gain in the horizontal direction has been shown to go from approximately a −7 dBi at 30 MHz to over 12 dBi at 150 MHz. It has also been shown that with alumina tile as the primary armor layer on top of a spaul layer, in turn backed by a rubber insulating layer and in turn mounted to the ground plane provided by the exterior of a vehicle, the VSWR across the entire band from 30 MHz to 450 MHz was found to be 3:1 or less.

Note that it was found that gain at 30 MHz was similar to that of standard whip antennas such as the AS3916.

In summary, an extremely thin embedded antenna for an armor-carrying vehicle utilizes a dipole driven element to the inside of the armor plate and a parasitically-driven dipole element on top of the armor plate, with the parasitic element providing appropriate forward gain and antenna matching characteristics such that there need be no aperturing of the armor plate in order to feed the antenna. In one embodiment, the bowtie antenna elements are elongated, extended or expanded by outboard antenna sections which are spaced from the distal ends of the corresponding bowties, with a meanderline choke bridging the gap between a bowtie element and its extended portion.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
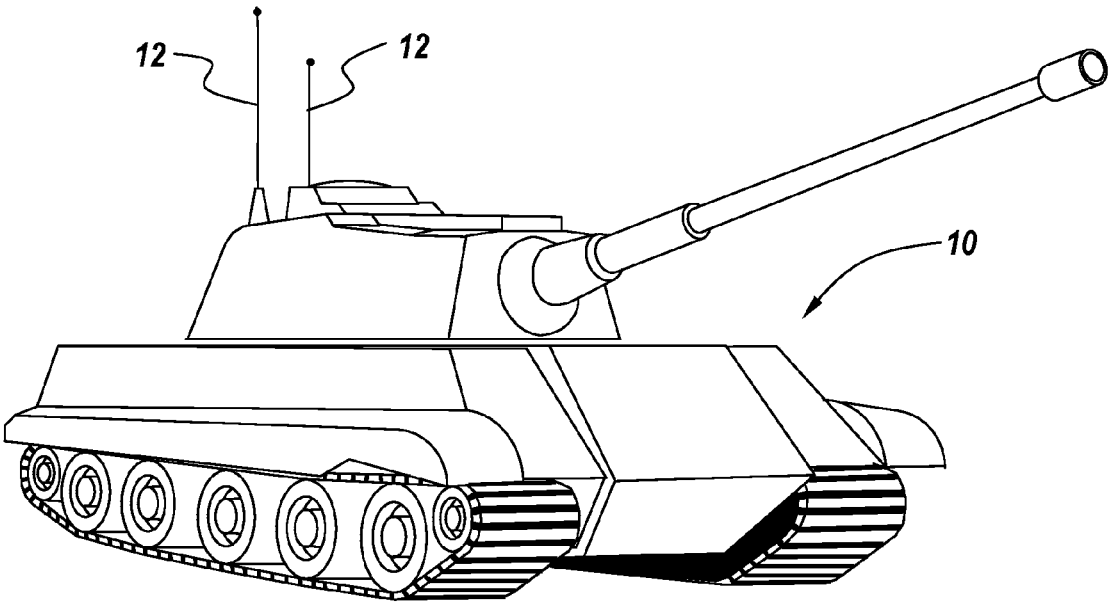
Fig. 1 (Prior Art)
FIG. 1 is a diagrammatic illustration of a tank sporting a pair of whip antennas which are exceedingly vulnerable to enemy fire and which are subject to damage.

Referring now to FIG. 1, in the prior art a tank 10 or other armored vehicle may be provided with a number of whip antennas 12 which extend above the vehicle and which are tuned to various frequency bands.

The problem with such a configuration is that the whips are extremely vulnerable to explosive destruction as well as being torn off the vehicle by overhead limbs and the like.

It will be appreciated that in order to cover the bands of interest for communication with such a vehicle the number of bands that are required are multiple. It would be desirable to have communication antennas for such vehicles operate in a 30 MHz to 425 MHz band. However, antennas that are wideband enough do not exist other than in whip form.

Figure 2:
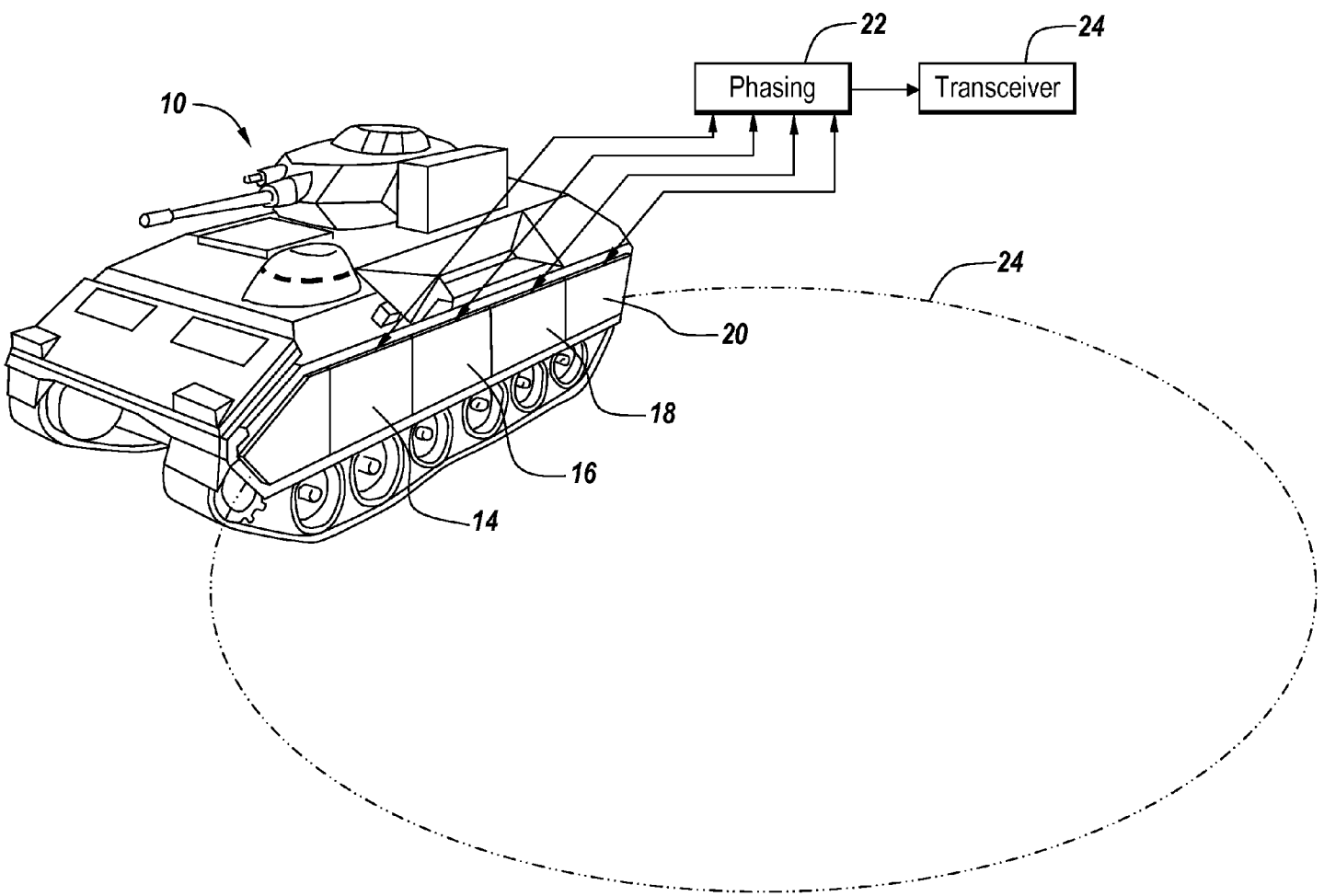
FIG. 2 is a diagrammatic illustration of the utilization of the subject embedded dipoles in a number of adjacent armor panels located on the side of a tank showing the ability to phase the embedded bowties for directional purposes, with the bowties when fed in parallel providing a 180° pattern to each side of the tank.

Referring now to FIG. 2, it is the purpose of the subject invention to provide a conformal embedded antenna structure for vehicle 10 in which embedded antenna structures are provided in plates 14, 16, 18 and 20 that when appropriately phased by a phasing network 22 result in an antenna lobe 24 which as illustrated has a 180° azimuthal coverage. Providing the tank with embedded antenna plates on both sides provides a 360° coverage.

The antennas are capable of being used in a transmit and receive mode such that a transceiver 24 can listen for signals in 180° about the horizon, or can transmit signals from the transceiver through the panel-embedded antennas with an antenna pattern such as that shown by reference character 24.

The challenge therefore is to be able to provide a panel-embedded thin antenna structure, which provides close to 180° coverage per side and yet has an ultra wideband coverage characteristic.

Figure 3A:
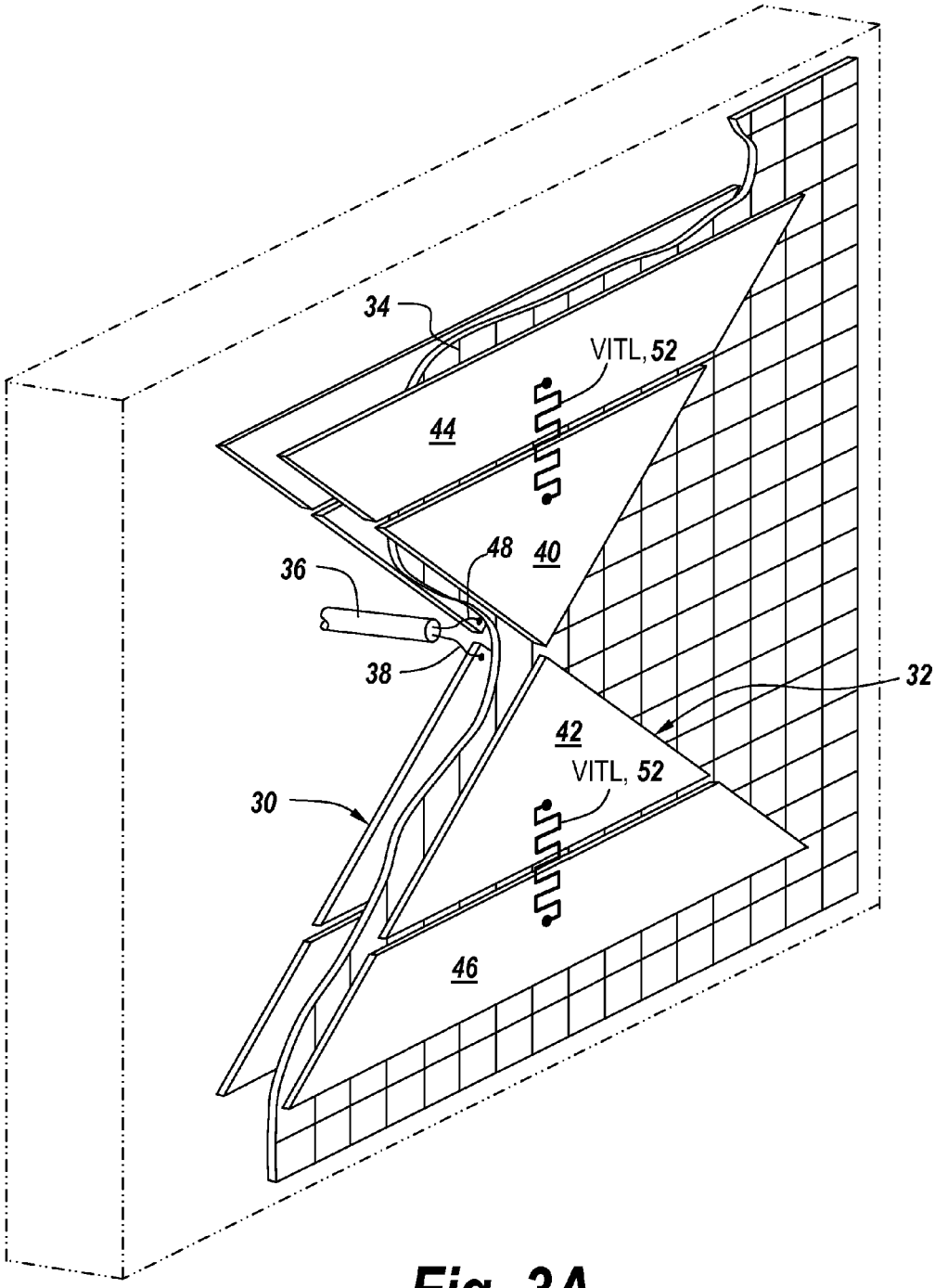
FIG. 3A is a diagrammatic illustration of one of the panels of FIG. 2 illustrating a bowtie driven element to the inside of a armor layer, with an identical bowtie to the outside of the armor layer, and with the bowties having extensions that are coupled to the adjacent portions of the bowtie with a meanderline choke so as to provide the antenna to operate both in the VHF range and the UHF range.

In order to do so and referring now to FIG. 3A, a pair of dipole antennas 30 and 32 are located to either side of an alumina tile armor layer 34 such that the inner dipole 30 is driven by a transmission line 36 having conductors 38 and 40 which do not pierce the armor layer 34 tiles. The result is an unapertured armor layer in which energy is coupled to an inner bowtie without having to provide holes in the armor plate.

The bowtie 32 is parasitically driven by bowtie 30 such that sufficient gain is achieved over the operating range of the antenna.

In order to provide the antenna with the aforementioned VHF and UHF range inner bowtie elements 40 and 42 are provided with associated extension plates 44 and 46 to increase the volume of the antenna and therefore provide that it resonate at lower and lower frequencies depending on the size of the extensions.

For UHF purposes bowtie elements 40 and 42 provide coverage from 225 MHz to 450 MHz. On the other hand, VITL meanderlines 50 and 52 which act as chokes at 225 MHz effectively couple the extended plates of the bowtie to the original plates for frequencies below 225 MHz. These VITL meanderline devices permit the ultra wideband range of the antenna by acting as shorts below 225 MHz and act as a choke above 225 MHz, such that the antenna size in the UHF region of the electromagnetic spectrum only that associated with elements 40 and 42. In the VHF region of the electromagnetic spectrum bowtie element 40 in combination with extension 44, and bowtie element 42 in combination with extension element 46 provide coverage below 225 MHz and in one embodiment all the way down to 30 MHz.

Figure 3B:
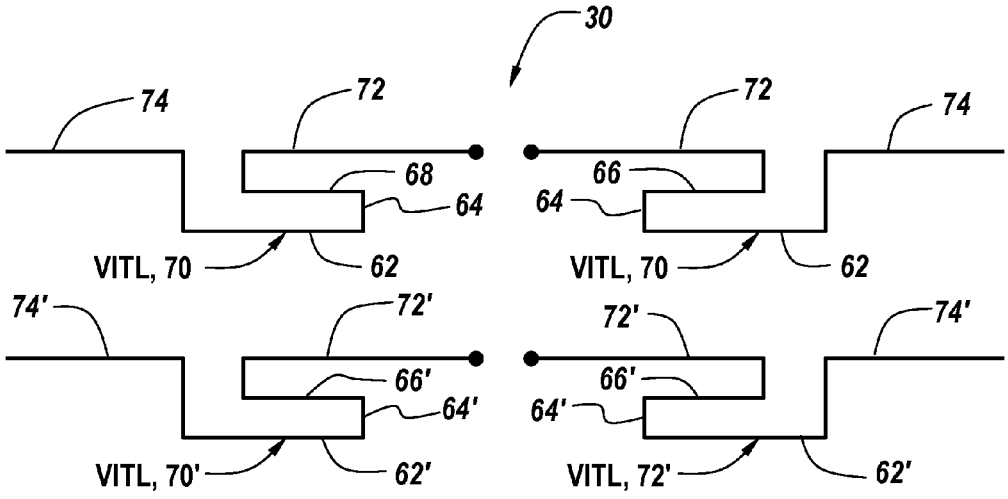
FIG. 3B is a diagrammatic illustration of the meanderline structure between the extension of a bowtie and the associated original bowtie element.

The meanderline or VITL structures are shown in FIG. 3B for the driven dipole 30 such that the meanderline elements 62, 64 and 66 constitute the aforementioned VITL choke meanderlines 70 between dipole elements 72 and extensions 74.

What is described for the driven element is also true for the parasitic element in which like reference characters carry a prime notation for like elements in the parasitic dipole case.

Figure 4:
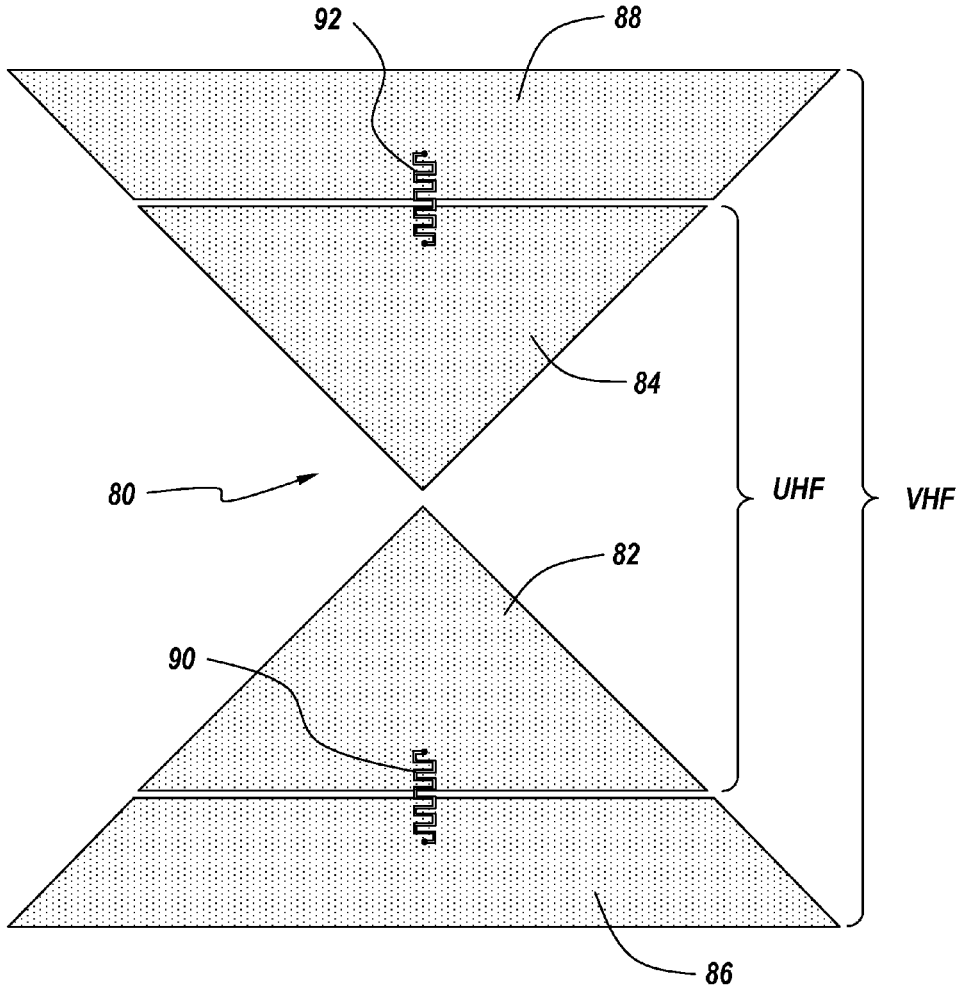
FIG. 4 is a diagrammatic illustration of one of the bowtie antennas in which the inner dipole is operable in the UHF region of the electromagnetic spectrum and in which the combined dipole and associated extensions operate in the VHF region of the electromagnetic spectrum.

The result as shown in FIG. 4 is that for a given bowtie dipole 80 dipole bowtie elements 82 and 84 if unconnected to extensions 86 and 88 result in a UHF antenna, whereas when the extensions are connected to associated bowtie elements a VHF antenna is achieved. The reason for this is the operation of the chokes, here shown by VITL meanderlines 90 and 92.

Figure 5:
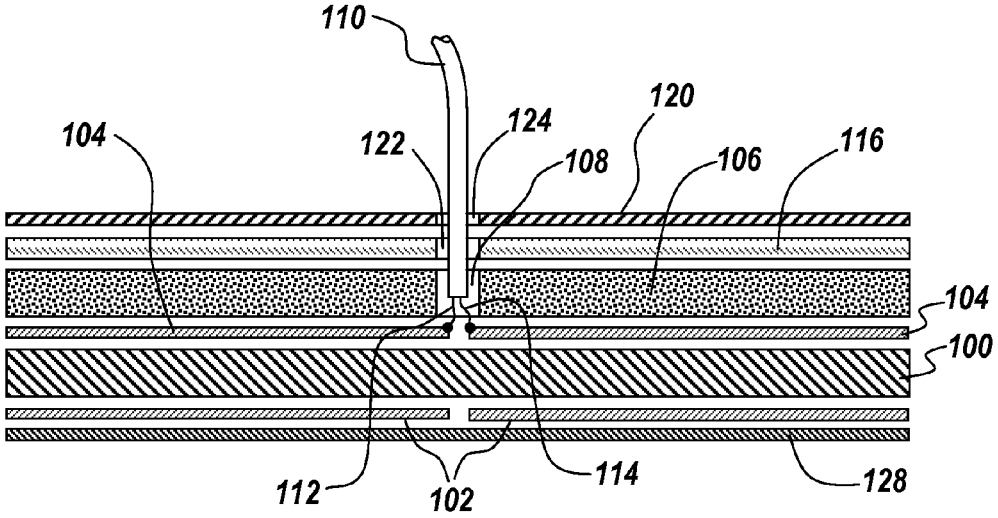
FIG. 5 is a cross sectional view of the dipole structure of FIG. 3A illustrating the feeding of the inner dipole through apertures in a spaul layer and a rubber liner, whereas the armor layer is left unpenetrated.

Referring to FIG. 5, an armor layer or plate 100 in the form of alumina tiles has a pair of parasitic dipole elements 102 to the outside of this layer. To the inside of layer 100 are identical dipole elements 104 which are to the outside of a spaul layer 106 which may be for instance made of Spectra®. Spaul layer 106 is apertured at 108 to provide access for feedline 110 and its conductors 112 and 114 to connect to driven dipole elements 104.

In one embodiment an apertured rubber liner 116 is provided between spaul layer 106 and ground plane 120, with the rubber liner 116 being apertured at 122 and with the ground plane being apertured at 124.

In a preferred embodiment a radome or electrically transparent shield 128 is utilized to protect the parasitic dipole elements.

In one embodiment, a 24 inch by 24 inch armor panel was provided with ceramic tiles, a Kevlar spaul layer and a radome layer covering the tiles. The driven element was provided as a first metalized layer on top the spaul material, while the top element was patterned on top of the tiles to form the parasitic radiator. For the UHF portion of the antenna the distal edges of the driven and parasitic bowties are 6.0 inches in length, with a 1 inch spaul layer utilized. The ceramic tiles in one embodiment are 0.4 inches thick and the radome layer is 0.010 inch in thickness.

It has been found with this configuration that the UHF antenna formed by dipole elements 102 and 104 operates with sufficient gain and sufficient bandwidth across the 225-450 MHz bands. As mentioned hereinbefore, when the dipole elements are provided with extensions and meanderlines a VHF capability is achieved.

Figure 6:
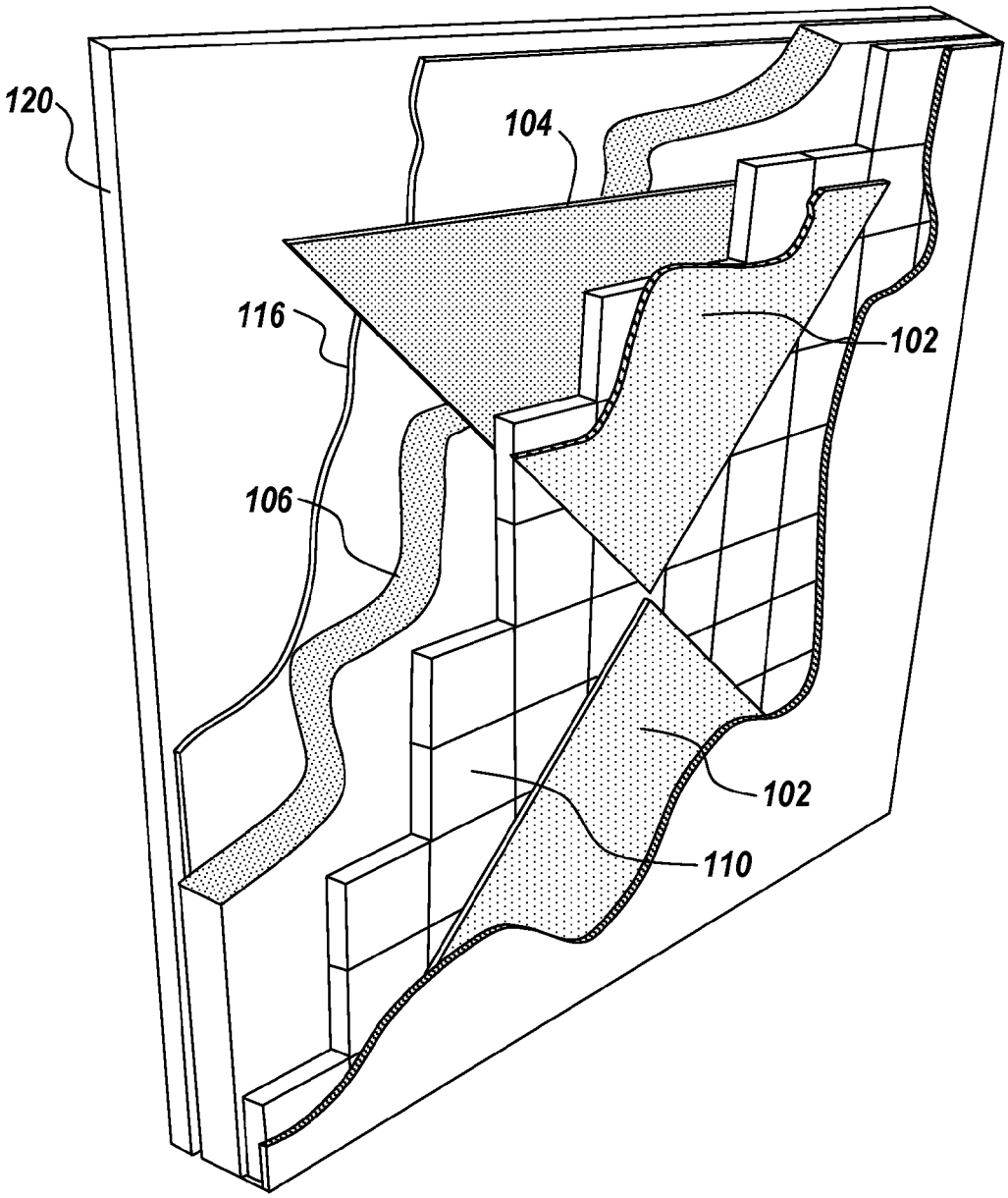
FIG. 6 is a diagrammatic illustration of the embedded thin antenna of FIG. 5 illustrating not only the dipoles which surround the armor layer but also the spaul layer and the rubber liner atop a ground plane.

Referring to FIG. 6, the elements between FIG. 5 and FIG. 6 carry like reference characters, with a FIG. 6 cutaway drawing illustrating the preferred configuration of the subject thin embedded antenna system.

Figure 7:
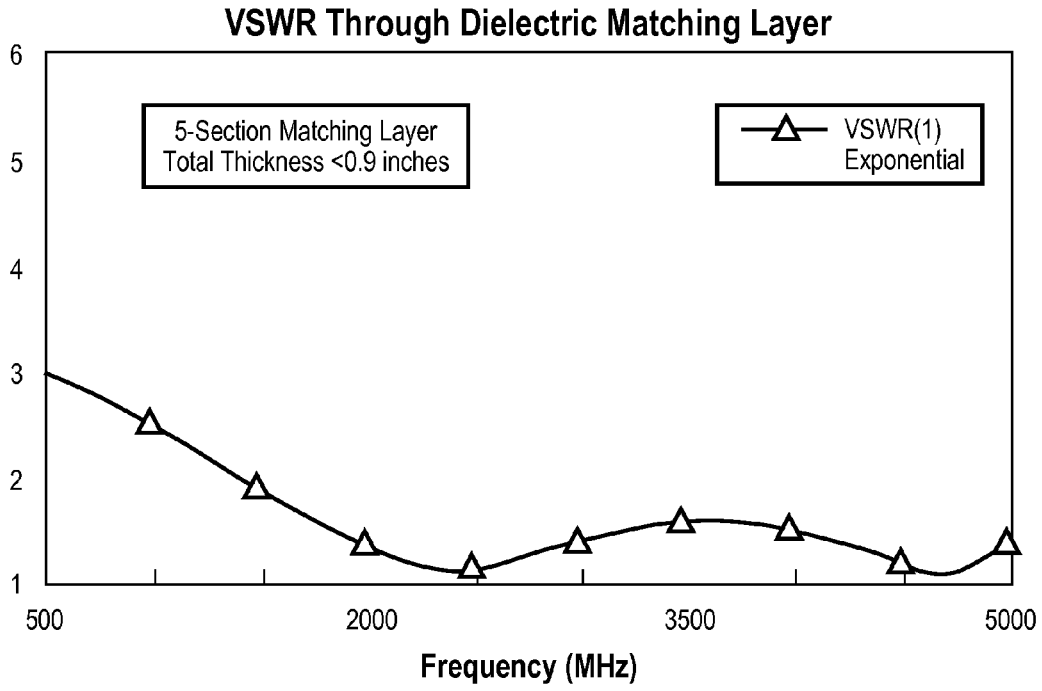
FIG. 7 is a graph showing VSWR through a dielectric matching layer, illustrating that the VSWR can be kept to under 3:1 from 500 MHz to 5,000 MHz.

Referring now to FIG. 7, it has been found that the VSWR through the dielectric matching layer is less than 3:1 all the way from 500 MHz to 5,000 MHz. Thus, it is possible through appropriate dielectric matching techniques to make the VSWR tolerable across all the bands of interest.

Figure 8:
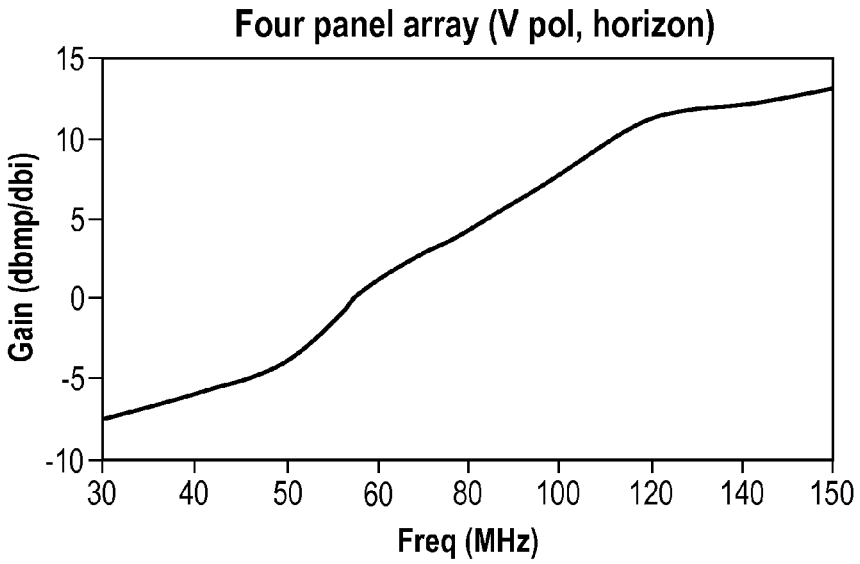
FIG. 8 is a graph showing gain of a four panel array from 30 MHz to 150 MHz.

Referring to FIG. 8, for a four panel vertically polarized array, the gain in the horizontal direction from 30 MHz to at least 150 MHz is from a −6 dB to approximately 14 dB, with the gain measured in terms of DPMP/dB.

Figure 9:
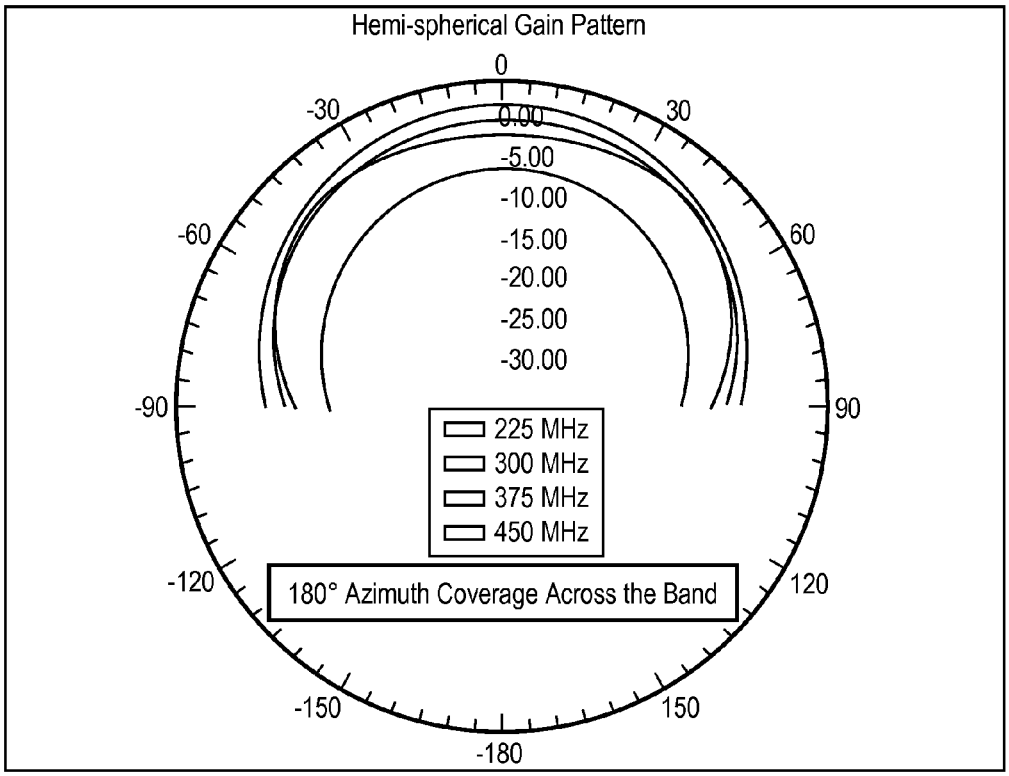
FIG. 9 is a hemispherical gain pattern graph showing 180° azimuthal coverage across selected bands from 225 MHz to 450 MHz corresponding to the UHF operating range of the subject antenna; and, FIG. 10 is a graph showing boresite gain versus frequency for the UHF portion of the subject antenna from 225 MHz to 450 MHz, showing sufficient gain across the UHF band.

Referring to FIG. 9 for the UHF portion of the subject antenna, a hemispherical gain pattern is achievable as illustrated for the 225 MHz band, 300 MHz band, 375 MHz band and the 450 MHz band, with the gains exceeding −6 dB.

Figure 10:
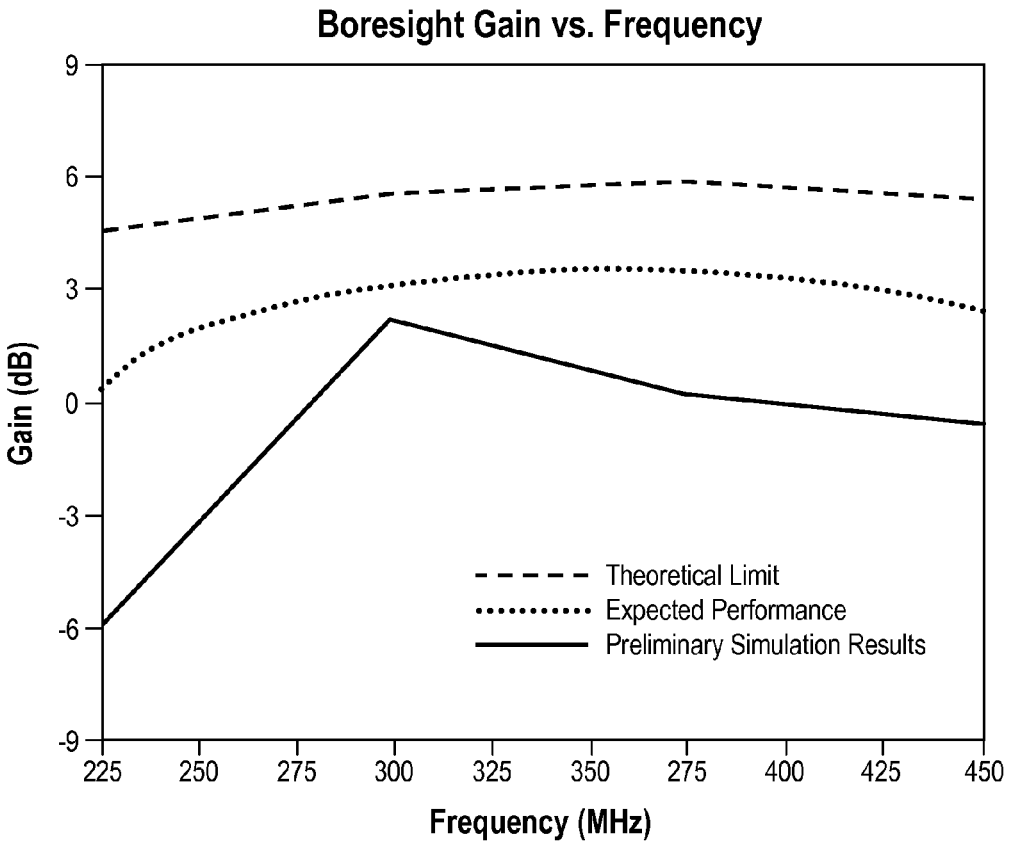

Finally with respect to FIG. 10, boresite gain versus frequency is plotted for a theoretical limit, an expected performance and preliminary simulation results for the UHF portion for the band covered by the subject antenna, namely the 225-450 MHz band. In the best case scenario, the theoretical limit of boresite gain is on the order of 5 dB or higher, whereas the expected gain is between 1 and 3 dB. Finally, preliminary simulation results indicate that at least a −6 dB gain is achievable at the low end of the UHF band, whereas better than zero gain is achievable above approximately 300 MHz.

What is therefore shown is a versatile wideband embeddable antenna system in which a parasitically driven bowtie or dipole exists to the exterior of an armor layer an in which a driven dipole is embedded underneath the armor layer. The purpose of being able to do this is to leave the armor layer unapertured such that its armor protective characteristics are unaltered by the embedding of the subject antenna.

Moreover, the bandwidth of the antenna can be extended through the utilization of outboard extensions to each of the original dipole elements, with a choke being placed between these elements to define the UHF operating characteristics when the choke is operative and the VHF operating characteristics when the choke essentially acts as a short between the outlying extensions and the original dipole elements.

Note the ground plate is directly under the spaul layer with small penetrations made in the spaul layer to allow for the antenna feed. These feeds pose a minimal impact to the performance of the armor since they do not penetrate the ceramic tiles.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A wideband embedded armor antenna comprising:

an armor layer mounted to a vehicle;

a driven dipole between said armor layer and said vehicle;

a parasitically driven dipole to the outside of said armor layer;

a feed for said driven dipole which does not pierce said armor layer, whereby said wideband embedded armor antenna is embedded in the armor layer without altering the characteristics of said armor layer; and, outboard extensions to each of the elements making up said dipoles and a choke between a dipole element and its associated extension.

2. The antenna of claim 1, wherein said choke has a cutoff frequency at the bottom of the UHF range.

3. The antenna of claim 2, wherein said choke has a cutoff frequency at 225 MHz.

4. The antenna of claim 1, wherein the frequency band associated with said dipoles includes the UHF band.

5. The antenna of claim 4, wherein said UHF band extends from 225 MHz to 450 MHz.

6. The antenna of claim 5, wherein said extensions are of a size to decrease the operating frequency of said antenna below the cutoff frequency of said choke.

7. The antenna of claim 6, wherein said chokes are set to a cutoff frequency at the lower end of the UHF band such that when said antenna operates in the VHF band said extensions expand the volume of the antenna to resonate in the VHF region of the electromagnetic spectrum.

8. The antenna of claim 1, and further including a spaul layer interposed between said driven dipole and said vehicle.

9. The antenna of claim 8, and further including a rubber liner between said spaul layer and said vehicle.

10. The antenna of claim 1, wherein said dipoles include bowtie shaped elements.

11. The antenna of claim 1, wherein said dipoles include bowtie shaped elements and wherein said extensions include trapezoidally-shaped elements.

12. The antenna of claim 11, wherein the chokes between said trapezoidally-shaped elements and said bowtie elements include a meanderline as the choke therebetween.

13. The antenna of claim 1, and further including a number of armor plates attached to the side of said vehicle, each of said armor plates including an embedded driven dipole antenna and an exterior parasitically-driven dipole antenna, and further including a phasing module for driving said antennas.

14. The antenna of claim 13, wherein said phasing module drives said antennas in-phase.

15. The antenna of claim 13, wherein said phasing module phases the feeds for said embedded antennas so as to provide a steerable beam therefrom.

* * * * *